US008258092B2

(12) United States Patent
McKechnie

(10) Patent No.: US 8,258,092 B2
(45) Date of Patent: Sep. 4, 2012

(54) CLEANING COMPOSITIONS AND METHODS

(75) Inventor: Malcolm Tom McKechnie, Hull (GB)

(73) Assignee: Reckitt Benckiser (UK) Limited, Slough, Berkshire (GB)

( * ) Notice: Subject to any disclaimer, the term of this patent is extended or adjusted under 35 U.S.C. 154(b) by 674 days.

(21) Appl. No.: 11/997,385

(22) PCT Filed: Jul. 14, 2006

(86) PCT No.: PCT/GB2006/002642

§ 371 (c)(1), (2), (4) Date: Apr. 29, 2008

(87) PCT Pub. No.: WO2007/017623

PCT Pub. Date: Feb. 15, 2007

(65) Prior Publication Data

US 2008/0230095 A1 Sep. 25, 2008

(30) Foreign Application Priority Data

Aug. 5, 2005 (EP) ..... 05017102

(51) Int. Cl.
*C11D 7/50* (2006.01)

(52) U.S. Cl. ..... 510/417; 510/405; 510/488

(58) Field of Classification Search ..... 252/183.11; 510/405, 417, 488
See application file for complete search history.

(56) References Cited

U.S. PATENT DOCUMENTS 6,800,154 B1 * 10/2004 Carey et al. ..... 149/2

FOREIGN PATENT DOCUMENTS

| | | | |
|---|---|---|---|
| GB | 2400609 A | | 10/2004 |
| JP | 11-049627 | * | 2/1999 |
| WO | 01/12133 A | | 2/2001 |
| WO | 2004/075869 A | | 9/2004 |
| WO | WO 2004075869 A1 | * | 9/2004 |

OTHER PUBLICATIONS

Database WPI, Section Ch, Week 199918, Dervent Publications Ltd., London, GB; Class A96, AN 1999-210707, XP002362313 & JP 11 049627 A (Kao Corp), Feb. 23, 1999 abstract.
English language equivalent of JP1104962 taken from esp@cenet.org.

* cited by examiner

*Primary Examiner* — Gregory Webb
(74) *Attorney, Agent, or Firm* — Norris McLaughlin & Marcus PA

(57) ABSTRACT

A cleaning composition comprises a water-in-oil emulsion which upon breakdown of the emulsion undergoes a physical change which is accompanied by an increase in the temperature of the composition.

15 Claims, No Drawings

CLEANING COMPOSITIONS AND METHODS

This is an application filed under 35 USC 371 of PCT/GB2006/002642.

This invention relates to cleaning compositions and cleaning methods, employing water-in-oil emulsions.

Consumers are aware that cleaning is often more effective at higher temperatures and many cleaning processes are carried out using hot water. For example, dish-washing or clothes-washing compositions are dissolved in large quantities of warm or hot water. In order to tackle stubborn soils, concentrated (neat) cleaning compositions are available for a user to apply directly to the soiled area. This has the advantage that a high concentration of cleaning agent may contact the soiled area. Concentrated (neat) compositions can be effective but their effectiveness is limited by the fact that the application is made at ambient temperature.

It would be highly desirable to provide a cleaning composition which has the capacity to be self-heating.

According to a first aspect of the present invention there is provided a cleaning composition comprising a water-in-oil emulsion which upon breakdown of the emulsion undergoes a physical change which is accompanied by an increase in the temperature of the composition.

In the initial emulsion, an aqueous phase is provided in the form of droplets surrounded by a continuous non-aqueous oily phase. When breakdown of the emulsion occurs, the droplets may be brought together so that they are no longer completely separated by the oil. This leads to a heat-generating physical change. By physical change, it is meant that there is a general change in the internal structure or other physical property of the emulsion.

There may optionally also be a chemical change which occurs when the emulsion breaks down. This may or may not be exothermic. In preferred embodiments, the increase in temperature is due entirely or substantially to the physical change which occurs when the emulsion breaks down. Preferably this is a phase change, preferably a crystallisation. Preferably the phase change is the crystallisation of an alkali metal salt of a weak acid. Preferably the weak acid is an organic acid having 1 to 4 carbon atoms. Most preferably it is acetic acid. Preferably the alkali metal is sodium.

Preferably the salt used has a relatively high solubility limit in water at an elevated temperature and a moderate solubility limit in water at ambient temperature. Preferably the ratio of the solubility of the salt at 100° C. to its solubility at 20° C. is at least 1.5:1, preferably at least 2:1, more preferably at least 3:1. Preferably the salt has the capacity to form a supersaturated solution at 20° C. containing an amount of salt in excess of the solubility limit at 20° C. and preferably containing an amount of the salt corresponding to the solubility limit at 60-100° C. By "solubility limit" is meant the maximum amount of solute which may be dissolved in a solvent at a particular temperature. In especially preferred embodiments of the invention, the aqueous phase of the composition comprises a supersaturated solution of sodium acetate. When the emulsion breaks down, the sodium acetate crystallises.

This is an exothermic process, releasing heat and thus increasing the temperature of the composition.

The temperature increase resulting from this heat output may be measured by locating a thermocouple on a surface to which the emulsion is applied.

Preferably the temperature increases by at least 5° C., more preferably by at least 10° C. and most preferably by at least 15° C.

Preferably the temperature of the composition increases by up to 70° C., more preferably by up to 50° C., and most preferably by up to 40° C.

Preferably the aqueous phase comprises at least 40% by weight of the composition, preferably at least 50% by weight, more preferably at least 60%, more preferably at least 70% and most preferably at least 75% by weight of the composition.

Preferably the aqueous phase comprises up to 99%, preferably up to 97% and more preferably up to 95% by weight of the composition.

In especially preferred embodiments, the aqueous phase comprises 80-90% by weight of the composition.

The aqueous phase preferably comprises a supersaturated solution of sodium acetate. A supersaturated solution comprises a concentration of sodium acetate which is greater than the solubility limit of sodium acetate which may be dissolved in water at ambient temperature, i.e. it is not possible to further dissolve any more sodium acetate—the solubility limit has been exceeded. Such a solution may be prepared by dissolving solute at a higher temperature to give a saturated solution which is then cooled or allowed to cool. Suitably the aqueous phase comprises 50 to 60% by weight sodium acetate, preferably it comprises 55% by weight. A solution comprising 55 wt % sodium acetate may be prepared by heating water to 90° C. and forming a saturated solution i.e., dissolving the maximum possible amount of sodium acetate. This solution is then allowed to cool or actively cooled (which may include quenching) to room temperature, resulting in the formation of a supersaturated solution.

The oil phase preferably comprises up to 60% by weight of the composition, preferably up to 40%, more preferably up to 25% by weight of the total weight of the composition.

The oil phase preferably comprises at least 1%, more preferably at least 3% and most preferably at least 5% by weight of the composition.

The oil phase may be based on widely diverse groups of oils, including natural oils, and mixtures thereof. The natural oils include animal oils and vegetable oils (e.g. castor oil, lard oil) as well as mineral oils such as liquid petroleum oils and solvent treated or acid-treated mineral oils of the paraffinic, naphthenic or mixed paraffinic-naphthenic types. Oils derived from coal or shale are also useful. Synthetic oils include hydrocarbon oils and halo-substituted hydrocarbon oils such as polymerized and interpolymerized olefins (e.g., polybutylenes, polypropylenes, propylene-isobutylene copolymers, chlorinated polybutylenes, etc.); poly(1-hexenes), poly(1-octanes), poly(1-decenes), etc. and mixtures thereof; alkyl-benzenes (e.g., dodecylbenzenes, tetradecylbenzenes, dinonylbenzenes, di(2-ethyhexyl)-benzenes, etc.); polyphenyls (e.g., biphenyls, terphenyls, alkylated polyphenyls, etc.); alkylated diphenyl ethers and alkylated diphenyl sulfides and the derivatives, analogues and homologues thereof and the like.

Alkylene oxide polymers and interpolymers and derivatives thereof where the terminal hydroxyl groups have been modified by esterification, etherification, etc., constitute another class of known synthetic oils that can be used. These are exemplified by the oils prepared through polymerization of ethylene oxide or propylene oxide, the alkyl and aryl ethers of these polyoxyalkene polymers (e.g., methyl-polyisopropylene glycol ether having an average molecular weight of about 1000, diphenyl ether of polyethylene glycol having a molecular weight of about 500-1000, diethyl ether of polypropylene glycol having a molecular weight of about 1000-1500, etc.) or mono- and polycarboxylic esters thereof, for example, the acetic acid esters, mixed $C_{3-8}$ fatty acid esters, or the $C_{13}$ oxo acid diester of tetraethylene glycol.

Another suitable class of synthetic oils that can be used comprises the esters of dicarboxylic acids (e.g., phthalic acid, succinic acid, alkyl succinic acids, alkenyl succinic acids, maleic acid, azelic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyladipate, di(2-ethylhexyl)sebacate, di-n-hexylfumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$-$C_{12}$ monocarboxylic acids and polyol esters such as neopentyl glycol, trimethylol propane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl) silicate, tetra-(4-methyl-hexyl)silicate, tetra(p-tert-butylphenyl)silicate, hexyl-(4-methyl-2-pentoxy)disiloxane, poly(methyl)siloxanes, poly-(methylphenyl)siloxanes etc.). Other synthetic oils include liquid esters of phosphorous-containing acids (e.g., tricresyl phosphate, trioctyl phosphate, diethyl ester of decane phosphonic acid, etc.), polymeric tetrahydrofurans and the like.

Unrefined, refined and rerefined oils, either natural or synthetic (as well as mixtures of two or more of any of these) of the type disclosed hereinabove can be used. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service.

Most preferably, the oil phase of the emulsion of the present invention comprises a mineral oil.

A common problem with the use of emulsions is that there is often some transport between the oil and water phases. Preferred compositions of the invention have substantially no transport between the oil and water phases. They are only self-heating upon breakdown of the emulsion. To avoid problems associated with transport between phases, the composition of the present invention preferably further comprises up to 10% by weight of a surfactant, preferably up to 8%, more preferably up to 5%, preferably up to 3%, and most preferably up to 2% by weight of the total composition.

Preferably the composition comprises at least 0.01% by weight surfactant, preferably at least 0.05%, more preferably at least 0.1% and most preferably at least 0.2% by weight.

The cleaning composition desirably includes at least one surfactant selected from anionic, cationic, non-ionic or amphoteric (zwitterionic) surfactants.

Examples of anionic surfactants which may be used in the cleaning composition include but are not limited to: alkali metal salts, ammonium salts, amine salts, aminoalcohol salts or the magnesium salts of one or more of the following compounds: alkyl sulphates, alkyl ether sulphates, alkylamidoether sulphates, alkylaryl polyether sulphates, monoglyceride sulphates, alkylsulphonates, alkylamide sulphonates, alkylarylsulphonates, olefinsulphonates, paraffin sulphonates, alkyl sulphosuccinates, alkyl ether sulphosuccinates, alkylamide sulphosuccinates, alkyl sulphosuccinamate, alkyl sulphoacetates, alkyl phosphates, alkyl ether phosphates, acyl sarconsinates, acyl isothionates and N-acyl taurates. Generally, the alkyl or acyl group in these various compounds comprises a carbon chain containing 12 to 20 carbon atoms.

Other anionic surfactants which may be used include fatty acid salts, including salts of oleic, ricinoleic, palmitic and stearic acids; copra oils or hydrogenated copra oil acid, and acyl lactylates whose acyl group contains 8 to 20 carbon atoms.

One class of nonionic surfactants which may be used in the cleaning composition are alkoxylated alcohols, particularly alkoxylated fatty alcohols. These include ethoxylated and propoxylated fatty alcohols, as well as ethoxylated and propoxylated alkyl phenols, preferably having alkyl groups of from 7 to 16, more preferably 8 to 13 carbon atoms in length.

Examples of alkoxylated alcohols include certain ethoxylated alcohol compositions presently commercially available from the Shell Company, (Houston, Tex.) under the general trade name NEODOL (trade mark), which are described to be linear alcohol ethoxylates and certain compositions presently commercially available from the Union Carbide Company, (Danbury, Conn.) under the general trade name TERGITOL (trade mark), which are described to be secondary alcohol ethoxylates.

Examples of alkoxylated alkyl phenols include certain compositions presently commercially available from the Rhone-Poulenc Company (Cranbury, N.J.) under the general trade name IGEPAL (trade mark), which are described to be octyl and nonyl phenols.

A further class of non-ionic surfactants include those in which the major portion of the molecule is made up of block polymeric $C_2$-$C_4$ alkylene oxides, with alkylene oxide blocks containing $C_3$ to $C_4$ alkylene oxides. Such nonionic surfactants, while preferably built up from an alkylene oxide chain starting group, can have as a starting nucleus almost any active hydrogen containing group including, without limitation, amides, phenols, and secondary alcohols.

One group of nonionic surfactants containing the characteristic alkylene oxide blocks are those which may be generally represented by the formula (A):

$$HO—(EO)_x(PO)_y(EO)_z—H \quad (A)$$

where

EO represents ethylene oxide,

PO represents propylene oxide, y equals at least 15, $(EO)_{x+z}$ equals 20 to 50% of the total weight of said compounds, and, the total molecular weight is preferably in the range of about 2000 to 15,000.

Another group of nonionic surfactants appropriate for use can be represented by the formula (B):

$$R—(EO,PO)_a(EO,PO)_b—H \quad (B)$$

wherein R is an alkyl, aryl or aralkyl group, the alkoxy group contains 1 to 20 carbon atoms, the weight percent of EO is within the range of 0 to 45% in one of the blocks a, b, and within the range of 60 to 100% in the other of the blocks a, b, and the total number of units of combined EP and PO is in the range of 6 to 125 units, with 1 to 50 units in the PO rich block and 5 to 100 units in the EO rich block.

Further nonionic surfactants which in general are encompassed by Formula B include butoxy derivatives of propylene oxide/ethylene oxide block polymers having molecular weights within the range of about 2000-5000.

Still further useful nonionic surfactants containing polymeric butoxy (BO) groups can be represented by formula (C) as follows:

$$RO—(BO)_n(EO)_x—H \quad (C)$$

wherein R is an alkyl group containing 1 to 20 carbon atoms, n is about 15 and x is about 15.

Also useful as the nonionic block copolymer surfactants which also include polymeric butoxy groups are those which may be represented by the following formula (D):

$$HO—(EO)_x(BO)_n(EO)_y—H \quad (D)$$

wherein n is about 15, x is about 15 and y is about 15.

Still further useful nonionic block copolymer surfactants include ethoxylated derivatives of propoxylated ethylene diamine, which may be represented by the following formula:

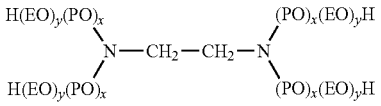

(E)

where (EO) represents ethoxy, (PO) represents propoxy, the amount of $(PO)_x$ is such as to provide a molecular weight prior to ethoxylation of about 300 to 7500, and the amount of $(EO)_y$ is such as to provide about 20% to 90% of the total weight of said compound.

Another class of non-ionic surfactants that may be used are sorbitan esters of fatty acids, typically of fatty acids having from 10 to 24 carbon atoms, for example sorbitan mono oleate.

A further class of non-ionic surfactants which may be used include amine oxides. Exemplary amine oxide compounds include those which may be defined as one or more of the following of the four general classes:

(A) Alkyl di(lower alkyl)amine oxides in which the alkyl group has about 6-24, and preferably 8-18 carbon atoms, and can be straight or branched chain, saturated or unsaturated. The lower alkyl groups include between 1 and 7 carbon atoms, but preferably each include 1-3 carbon atoms. Examples include octyl dimethyl amine oxide, lauryl dimethyl amine oxide, myristyl dimethyl amine oxide, and those in which the alkyl group is a mixture of different amine oxides, such as dimethyl cocoamine oxide, dimethyl(hydrogenated tallow)amine oxide, and myristyl/palmityl dimethyl amine oxide;

(B) Alkyl di(hydroxy lower alkyl)amine oxides in which the alkyl group has about 6-22, and preferably 8-18 carbon atoms, and can be straight or branched chain, saturated or unsaturated. Examples include bis-(2-hydroxyethyl)cocoamine oxide, bis-(2-hydroxyethyl)tallowamine oxide; and bis-(2-hydroxyethyl)stearylamine oxide;

(C) Alkylamidopropyl di(lower alkyl)amine oxides in which the alkyl group has about 10-20, and preferably 12-16 carbon atoms, and can be straight or branched chain, saturated or unsaturated. Examples are cocoamidopropyl dimethyl amine oxide and tallowamidopropyl dimethyl amine oxide; and (D) Alkylmorpholine oxides in which the alkyl group has about 10-20, and preferably 12-16 carbon atoms, and can be straight or branched chain, saturated or unsaturated.

A further class of non-ionic surfactants include those presently marketed under the trade name PLURONIC (trademark). The compounds are formed by condensing ethylene oxide with a hydrophobic base formed by the condensation of propylene oxide with propylene glycol, and are described by their manufacturer to have the following general structure:

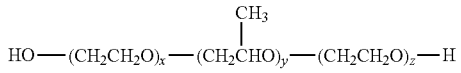

wherein x, y and z are selected such that the molecular weight of the block polymers varies from at least about 1,000 to about 15,000 and the polyethylene oxide content may comprise 5% to 90% by weight of the block polymer.

Amphoteric surfactants which may be used in the present invention include amphoteric betaine surfactant compounds having the following general formula:

$$R—N^+(R_1)_2—R_2COO^-$$

wherein R is a hydrophobic group which is an alkyl group containing from 10 to 22 carbon atoms, preferably from 12 to 18 carbon atoms, an alkylaryl or arylalkyl group containing a similar number of carbon atoms with a benzene ring being treated as equivalent to about 2 carbon atoms, and similar structures interrupted by amido or either linkages; each $R_1$ is an alkyl group containing from 1 to 3 carbon atoms; and $R_2$ is an alkylene group containing from 1 to 6 carbon atoms.

Further exemplary useful amphoteric surfactants include those selected from alkylampho(mono)- and (di)-acetates, alkylampho(mono)- and (di)-propionates, and aminopropionates. These amphoteric surfactants may be used singly, or in combination with further other amphoteric surfactants, but desirably are the sole amphoteric surfactants present in the compositions. Salt forms of these amphoteric surfactants may also be used. Exemplary alkylampho(mono)acetates include those according to the general structure:

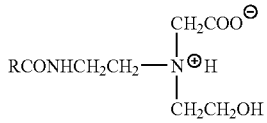

wherein R represents a R represents a C8 to C24 moiety; alkylampho(di)acetates according to either of the general structures:

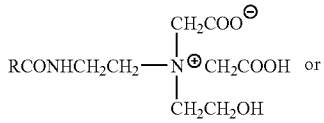

or

-continued

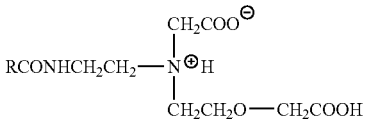

wherein R represents a R represents a C8 to C24 moiety; alkylampho(mono)propionates according to the according to the general structure:

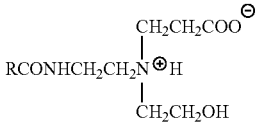

wherein R represents a R represents a C8 to C24 moiety; alkylampho(di)propionates according to either of the general structures:

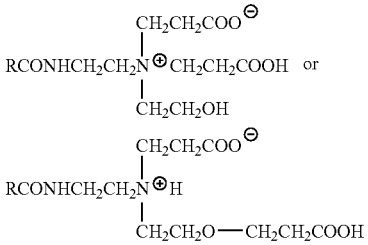

wherein R represents a R represents a C8 to C24 moiety; aminopropionates according to the following general structure:

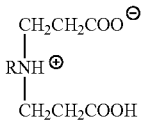

wherein R represents a R represents a C8 to C24 moiety. In each of the above indicated structures, R represents a $C_8$-$C_{24}$ alkyl group and desirably is a $C_{10}$-$C_{16}$ alkyl group, especially derived from soy or coconut, the latter of which typically provides a mixture of $C_{8-10}$, $C_{12}$, $C_{14}$ and $C_{16}$ alkyl groups.

Examples of cationic surfactants which may be used include quaternary ammonium compounds and salts thereof, including quaternary ammonium compounds which also have germicidal activity and which may be characterized by the general structural formula:

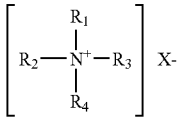

when at least one of $R_1$, $R_2$, $R_3$ and $R_4$ is a hydrophobic, aliphatic, aryl aliphatic or aliphatic aryl group containing from 6 to 26 carbon atoms, and the entire cationic portion of the molecule has a molecular weight of at least 165. The hydrophobic groups may be long-chain alkyl, long-chain alkoxy aryl, long-chain alkyl aryl, halogen-substituted long-chain alkyl aryl, long-chain alkyl phenoxy alkyl or aryl alkyl. The remaining groups on the nitrogen atoms, other than the hydrophobic radicals, are generally hydrocarbon groups usually containing a total of no more than 12 carbon atoms. The radicals $R_1$, $R_2$, $R_3$ and $R_4$ may be straight chain or may be branched, but are preferably straight chain, and may include one or more amide or ester linkages. The radical X may be any salt-forming anionic radical.

Examples of quaternary ammonium salts within the above description include the alkyl ammonium halides such as cetyl trimethyl ammonium bromide, alkyl aryl ammonium halides such as octadecyl dimethyl benzyl ammonium bromide, and N-alkyl pyridinium halides such as N-cetyl pyridinium bromide. Other suitable types of quaternary ammonium salts include those in which the molecule contains either amide or ester linkages, such as octyl phenoxy ethoxy ethyl dimethyl benzyl ammonium chloride and N-(laurylcocoaminoformylmethyl)-pyridinium chloride.

Most suitable surfactants are those which are oleophilic. Preferred surfactants are those which have a HLB value of ten or less.

The compositions of the present invention may comprise a mixture of two or more surfactants. Where two or more surfactants are present, any reference to a surfactant refers to all such surfactants and any ranges or amount of components refers to the total amount of surfactants present.

Especially preferred surfactants are those formed by the reaction of succinic acid I or succinic anhydride II, with a polyol, a polyamine or a hydroxylamine.

I

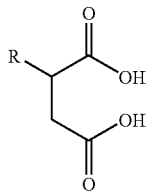

II

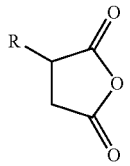

R is a hydrocarbon group having from about 12 to about 200 carbon atoms, preferably 12 to about 100 carbon atoms, more preferably 12 to 50 and most preferably 18 to 30 carbon atoms.

The hydrocarbon group R in the above formulae may be derived from an alpha-olefin or an alpha-olefin fraction. The alpha-olefins include 1-dodecene, 1-tridecene, 1-tetradecene, 1-pentadecene, 1-hexadecene, 1-heptadecene, 1-octadecene, 1-eicosene, 1-tricontene, and the like. The alpha olefin factions that are useful include $C_{15-18}$ alpha-olefins, $C_{12-16}$ alpha-olefins, $C_{14-16}$ alpha-olefins, $C_{14-18}$ alpha-olefins, $C_{16-18}$ alpha-olefins, $C_{18-24}$ alpha-olefins, $C_{18-30}$ alpha-olefins, and the like. Mixtures of two or more of any of the foregoing alpha-olefins or alpha-olefin fractions may be used.

In one embodiment, R in the above formulae is a hydrocarbon group derived from an olefin oligomer or polymer.

The olefin oligomer or polymer may be derived from an olefin monomer of 2 to about 10 carbon atoms, and in one embodiment about 3 to about 6 carbon atoms, and in one embodiment about 4 carbon atoms. Examples of the monomers include ethylene; propylene; 1-butane; 2-butane; isobutene; 1-pentene; 1-heptene; 1-octane; 1-nonene; 1-decene; 2-pentene; or a mixture of two or more thereof.

In a preferred embodiment, R in the above formulae is a polyisobutene group. The polyisobutene group may be made by the polymerization of a $C_4$ refinery stream having a butene content of about 35 to about 75% by weight and an isobutene content of about 30 to about 60% by weight.

In one embodiment, R in the above formulae is a polyisobutene group derived from a polyisobutene having a high methylvinylidene isomer content, that is, at least about 50% and in one embodiment at least about 70% methylvinylidenes. Suitable high methylvinylidenes polyisobutenes include those prepared using boron trifluoride catalysts. The preparation of such polyisobutene in which the methylvinylidene isomer comprises a high percentage of the total olefin composition is described in U.S. Pat. Nos. 4,152,499 and 4,605,808, the disclosure of each of which are incorporated herein by reference.

To form the surfactant used in the present invention, those succinic acids or anhydrides are reacted with polyols, polyamines or hydroxyamines.

Suitable polyols include: ethylene glycol, diethylene glycol, triethylene glycol, tetraethylene glycol, propylene glycol, dipropylene glycol, tripropylene glycol, dibutylene glycol, tributylene glycol, 1-2-butanedoil, 2,3-dimethyl-2,3-butanediol, 2,3-butanediol, 2,3-hexanediol, 1,2-cyclohexanediol, pentaerythritol, dipentaerythritol, 1,7-heptanediol, 2,4-heptanediol, 1,2,3-hexanetriol, 1,2,5-hexantriol, 2,3,4-hexantriol, 1,2,3-butanetriol, 1,2,4-butanetriol, 2,2,6,6-tetrakis-(hydroxymethyl)cyclohexanol, 1,10-decanediol, digitalose, 2-hydroxymethyl-2-methyl-1,3-propanediol-(tri-methylolethane), or 2-hydroxymethyl-2-ethyl-1,3-propanediol-(trimethylolpropane), and the like, or mixtures thereof; sugars, starches, or mixtures thereof, for example erythritol, threitol, adonitol, xylitol, sorbitol, mannitol, erythrose, fucose, ribose, xylulose, arabinose, xylose, glycose, fructose, sorbose, mannose, sorbitan, glucosamine, sucrose, rhamnose, glyceraldehydes, galactose, and the like; glycerol, diglycerol, triglycerol, and the like, or mixtures or isomers thereof; monooleate of glycerol, monostearate of glycerol, monooleate of sorbitol, distearate of sorbitol, didodecanoate of erythritol, or mixtures thereof.

Suitable polyamines may be aliphatic, cycloaliphatic, heterocyclic or aromatic. Examples include alkylene polyamines and heterocyclic polyamines.

Suitable alkylene polyamines include ethylene polyamines, butylene polyamines, propylene polyamines, pentylene polyamines, etc. The higher homologues are related to heterocyclic amines such as piperazines and N-amino alkyl-substituted piperazines are also included. Specific examples of such polyamines include ethylene diamine, triethylene tetramine, tris-(2-aminoethyl)amine, propylene diamine, trimethylene diamine, tripropylene tetramine, tetraethylene pentamine, hexaethylene heptamine, pentaethylene hexamine or a mixture of two or more thereof.

The polyamine may also be selected from the heterocyclic polyamines, for example aziridines, azetidines, azolidines, tetra- and dihydropyridines, pyrroles, indoles, piperidines, imidazoles, di- and tetra-hydroimidazoles, piperazines, isoindoles, purines, morpholines, thiomorphines, N-aminoalkylmorpholines, N-aminoalkylthiomorpholines, N-aminoalkylpiperazines, N,N'-diaminoalkylpiperazines, azepines, azocines, azecines and tetra-, di- and perhydro derivatives of each of the above and mixtures thereof. Useful heterocyclic amines are the saturated 5- and 6-membered heterocyclic amines containing only nitrogen, oxygen and/or sulfur in the hetero ring, especially the piperidines, piperazines, thiomorpholines, morpholines, and pyrrolidines. Suitable compounds include piperidine, aminoalkyl-substituted piperidines, piperazine, aminoalkyl-substituted piperazines, morpholine, aminoalkyl-substituted morpholines, pyrrolidine, and N-aminoalkyl-substituted pyrrolidines such as N-aminopropylmopholine, N-aminoethylpiperazine, and N,N'-diaminoethylpiperazine.

Suitable hydroxyamines may be a primary, secondary or tertiary amine. The hydroxyamine may be an N-(hydroxyl)-substituted alkyl amine, a hydroxyl-substituted polyalkoxy analogue thereof, or a mixture of such compounds. The hydroxylamine suitably contains from about 1 to about 40 carbon atoms, preferably 1 to 20 carbon atoms, more preferably 1 to 10 carbon atoms.

Primary, secondary and tertiary hydroxyamines may be represented by the following formulae:

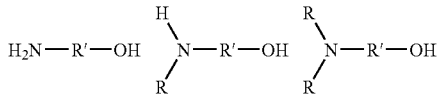

wherein each R is independently an alkyl group of one to about eight carbon atoms or hydroxyl-substituted alkyl group of about two to about 18 carbon atoms. Typically each R is a lower alkyl group of up to seven carbon atoms. The group —R'—OH in such formulae represents the hydroxyl-substituted hydrocarbon group. R' can be an acrylic, alicyclic or aromatic group. Typically, R' is an acyclic straight or branched alkylene group such as an ethylene, 1,2-propylene, 1,2-butylene, 1,2-octadecylene, etc, group.

When two R groups are present in the same molecule they can be joined by a direct carbon-to-carbon bond or through a heteroatom (e.g., oxygen, nitrogen or sulfur) to form a 5-, 6-, -7 or 8-members ring structure. Examples of such heterocyclic amines include N-(hydroxyl lower alkyl)-morpholines, thiomorpholines, piperidines, oxazolidines, thiazolidines and the like.

The hydroxyamines may be either N-(hydroxy-substituted hydrocarbyl)amines. These may be hydroxyl-substituted poly)alkoxy)analogues of the above-described hydroxy amines (these analogues also include hydroxyl-substituted oxyalkylene analogues). Such N-(hydroxyl-substituted hydrocarbon)amines may be conveniently prepared by reaction of epoxides with afore-described amines.

Polyamine analogues of these hydroxy amines, especially alkoxylated alkylene polyamines (e.g. N,N-(diethanol)-ethylene diamine) may also be used.

Specific examples of alkoxylated alkylene polyamines include N-(2-hydroxyethyl)ethylene diamine, N,N-bis(2-hydroxyethyl)-ethylene-diamine, 1-(2-hydroxyethyl)piperazine, mono(hydroxypropyl)-substituted diethylene triamine, di(hydroxypropyl)-substituted tetraethylene pentamine, N-(3-hydroxybutyl)tetramethylene diamine, etc. Higher homologues are also useful.

Examples of the N-(hydroxyl-substituted hydrocarbyl) amines include mono-, di-, and triethanolamine, diethylethanolamine, di(3-hydroxylpropyl)amine, N-(3-hydroxybutyl) amine, N-(4-hydroxybutyl)amine, N-,N-di-(2-hydroxypropyl)amine, N-(2-hydroxylethyl)morpholine and its thio analogue, N-(2-hydroxyethyl)cyclohexylamine, N-3-hydroxyl cyclopentyl amine, o-, m- and p-aminophenol, N-(hydroxylethyl)piperazine, N,N'-di(hydroxylethyl)piperazine, and the like.

Further hydroxyamines are the hydroxy-substituted primary amines described in U.S. Pat. No. 3,576,743 by the general formula $$R_a—NH_2$$

wherein $R_a$ is a monovalent organic group containing at least one alcoholic hydroxy group.

Specific examples of the hydroxy-substituted primary amines include 2-amino-1-butanol, 2-amino-2-methyl-1-propanol, p-(beta-hydroxyethyl)-aniline, 2-amino-1-propanol, 3-amino-1-propanol, 2-amino-2-methyl-1,3-propanediol, 2-amino-2-ethyl-1,3-propanediol, N-(betahydroxypropyl)-N'-(beta-aminoethyl)-piperazine, tris-(hydroxymethyl)aminoethane (also known as trismethylolaminomethane), 2-amino-1-butanol, ethanolamine, beta-(beta-hydroxyethoxy)-ethylamine, glucamine, glucosamine, 4-amino-3-hydroxy-3-methyl-1-butene, N-3(aminopropyl)-4-(2-hydroxyethyl)-piperadine, 2-amino-6-methyl-6-heptanol, 5-amino-1-pentanol, N-(beta-hydroxyethyl)-1,3-diamino propane, 1,3-diamino-2-hydroxypropane, N-(beta-hydroxyethoxyethyl)-ethylenediamine, trismethylol aminoethane and the like.

Hydroxyalkyl alkylene polyamines having one or more hydroxyalkyl substituents on the nitrogen atoms, are also useful. Examples include N-(2-hydroxyethyl)ethylene diamine, N,N-bis(2-hydroxyethyl)ethylene diamine, 1-2(hydroxyethyl)-piperazine, monohydroxypropyl-substituted diethylene triamine, dihydroxypropyl-substituted tetraethylene pentamine, N-(3-hydroxybutyl)tetramethylene diamine, etc. Higher homologues are also useful.

Other preferred surfactants include span 85 (sorbital trioleate) which has an HLB value of 1.8, octylphenol-1-ethyleneancy which has an HLB value of 4.0 and span 80 sorbital monocleate which has an HLB value of 4.3.

Other known surfactants not particularly described above may also be used. Those having an HLB value of less than 10 are preferred. Such surfactants are described in McCutcheon's Detergents and Emulsifiers, North American Edition, 1982; Kirk-Othmer, Encyclopaedia of Chemical Technology, 3rd Ed., Vol. 22, pp 346-387.

The composition of the present invention may further comprise one or more active cleaning agents. These may be provided in the aqueous or the oil phase or both. There may be one active cleaning agent provided in the aqueous phase and a different active cleaning agent, which may be incompatible with the first active cleaning agent, provided in the oil phase. Alternatively, there may be an active cleaning agent present in only one phase, or the same active cleaning agent may be present in both phases.

Suitable active cleaning agents include oxygen-supplying compounds including oxygen bleaches, other bleaches, enzymes, soaps, cleaning detergents, grease cutting agents, glossing agents, anti-microbial agents, builders, soil suspension agents, polishes, abrasive agents, thickeners, dye capture agents and anti-dye deposition agents.

Alternatively, the active cleaning agent may be generated in situ when the emulsion breaks down. Thus one cleaning agent precursor may be provided in the aqueous phase and another in the oil phase, for example a source of active oxygen and a bleach activator.

It could also be the case that the composition of the present invention does not comprise an active cleaning agent. Such a composition could be delivered to a locus after the delivery of a separate cleaning agent in order to enhance the effectiveness of the cleaning agent by the provision of heat. Such a composition is still to be regarded as a cleaning composition in this specification.

A cleaning composition may include one or more solvents to improve soil removal, selected for example, from lower alkyl monohydric alcohols, lower alkyl polyhydric alcohols, lower alkyl diols and glycol ethers, having the general structure Ra—O—Rb—OH, wherein Ra is an alkyl group of 1 to 20 carbon atoms, or an aryl group of at least 6 carbon atoms, and Rb is an alkylene group of 1 to 8 carbons, or is an ether or polyether containing from 2 to 20 carbon atoms. Preferred are glycol ethers having one to five glycol monomer units. Examples of more preferred solvents include methanol, ethanol, all isomeric forms of propanol, all isomeric forms of butanol, propylene glycol methyl ether, dipropylene glycol methyl ether, tripropylene glycol methyl ether, propylene glycol isobutyl ether, ethylene glycol methyl ether, ethylene glycol ethyl ether, ethylene glycol butyl ether, diethylene glycol phenyl ether, propylene glycol phenol ether, and mixtures thereof.

Exemplary bleach materials useful in the compositions of the present invention include alkali metal hypochlorites, chloroisocynanuric acids and N-chloro compounds containing an organic radical. N-chloro compounds are usually characterized by a double bond on the atom adjacent to a trivalent nitrogen and a chlorine (Cl+) attached to the nitrogen which is readily exchanges with H+ or M+ (where M+ is a common metal ion such as Na+, K+, etc.), so as to release HOCl or OCl— on hydrolysis.

Preferred alkali metal hypochlorite compounds useful in the detergent compositions described herein include sodium hypochlorite, potassium hypochlorite, and lithium hypochlorite as well as calcium hypochlorite and magnesium hypochlorite.

Preferred chlorine bleach materials useful in the detergent compositions described herein are chloroisocynanuric acids and alkali metal salts thereof, preferably potassium, and especially sodium salts thereof. Examples of such compounds include trichloroisocyananuric acid, dichloroisocyanuric acid, sodium dichloroisocyanurate, potassium dichloroisocyanurate, and trichloro-potassium dichloroisocynanurate complex.

Preferred N-chloro compounds useful as chlorine bleach materials in the subject compositions include trichloroliso-cyanuric acid, dichloroisocynauric acid, monochloroisocyanuric acid, 1,3-dichloro-5,5-dimethylhydantoin, 1-chloro-5,5-dimethylhydantoin, N-chlorosuccinimide, N-chlorosulphamate, N-chloro-p-nitroacetanilide, N-chloro-o-nitroacetanilide, N-chloro-m-nitroacetanilide, N-m-dichloroacetanilide, N-p-dichloroacetanilide, dichloramine-T, N-chloro-propionanilide, N-chlorobutyranilide, N-chloroacetanilide, N-o-dichloroacetanilide, N-chloro-p-acetotoluide, N-chloro-m-acetotoluide, N-chloroformanilide, N-chloro-o-acetotoluide, Chloramine-T, ammonia monochloramine, albuminoid chloramines, N-chlorosulphamide, Chloramine B, Dichloramine B, di-Halo (bromochlorodimethylhydantoin), N,N'-dichlorobenzoylene urea, p-toluene sulphodichloroamide, trichloromelamine, N-chloroammeline, N,N'-dichloroazodicarbonamide, N-chloroacetyl urea, N,N'-dichlorobiuret, chlorinated dicyandiamide, and alkali metal salts of the above acids, and stable hydrates of the above compounds.

Anti-microbial agents which may be included in the composition of the present invention include pyrithiones (especially zinc pyrithione which is also known as ZPT), dimethyldimethylol hydantoin (Glydant), methylchloroisothiazolinone/methylisothiazolinone (Kathon CG), sodium sulphite, sodium bisulphite, imidazolidinyl urea (Germall 115), diazolidinyl urea (Germaill II), benzyl alcohol, 2-bromo-2-nitropropane-1,3-diol (Bronopol), formalin (formaldehyde), iodopropenyl butylcarbamate (Polyphase P100), chloroacetamide, methanamine, methyldibromonitrile glutaronitrile (1,2-Dibromo-2,4-dicyanobutane or Tektamer), glutaraldehyde, 5-bromo-5-nitro-1,3-dioxane (Bronidox), phenethyl alcohol, o-phenylphenol/sodium o-phenylphenol, sodium hydroxymethylglycinate (Suttocide A), polymethoxy bicyclic oxazolidine (Nuosept C), dimethoxane, thimersal dichlorobenzyl alcohol, captan, chlorphenenesin, dichlorophene, chlorbutanol, glyceryl laurate, halogenated diphenyl ethers like 2,4,4-trichloro-2-hydroxy-diphenyl ether (Triclosan or TCS), 2,2-dihydroxy-5,5-dibromo-diphenyl ether, phenolic compounds like phenol, 2-methyl phenol, 3-methyl phenol, 4-methyl phenol, 4-ethyl phenol, 2,4-dimethyl phenol, 2,5-dimethyl phenol, 3,4-dimethyl phenol, 2,6-dimethyl phenol, 4-n-propyl phenol, 4-n-butyl phenol, 4-n-amyl phenol, 4-tert-amyl phenol, 4-n-hexyl phenol, 4-n-heptyl phenol, mono- and poly-alkyl and aromatic halophenols such as p-chlorophenol, methyl p-chlorophenol, ethyl p-chlorophenol, n-propyl p-chlorophenol, n-butyl p-chlorophenol, n-amyl p-chlorophenol, sec-amyl p-chlorophenol, n-hexyl p-chlorophenol, cyclohexyl p-chlorophenol, n-heptyl p-chlorophenol, n-octyl p-chlorophenol, o-chlorophenol, methyl o-chlorophenol, ethyl o-chlorophenol, n-propyl o-chlorophenol, n-butyl o-chlorophenol, n-amyl o-chlorophenol, tert-amyl o-chlorophenol, n-hexyl o-chlorophenol, n-heptyl o-chlorophenol, o-benzyl p-chlorophenol, o-benzyl-m-methyl p-chlorophenol, o-benzyl-m, m-dimethyl p-chlorophenol, o-phenylethyl p-chlorophenol, o-phenylethyl-m-methyl p-chlorophenol, 3-methyl p-chlorophenol, 3,5-dimethyl p-chlorophenol, 6-ethyl-3-methyl p-chlorophenol, 6-n-propyl-3-methyl p-chlorophenol, 6-iso-propyl-3-methyl p-chlorophenol, 2-ethyl-3,5-dimethyl p-chlorophenol, 6-sec-butyl-3-methyl p-chlorophenol, 2-iso-propyl-3,5-dimethyl p-chlorophenol, 6-diethylmethyl-3-methyl p-chlorophenol, 6-iso-propyl-2-ethyl-3-methyl p-chlorophenol, 2-sec-amyl-3,5-dimethyl p-chlorophenol 2-diethylmethyl-3,5-dimethyl p-chlorophenol, 6-sec-octyl-3-methyl p-chlorophenol, p-chloro-m-cresol, p-bromophenol, methyl p-bromophenol, ethyl p-bromophenol, n-propyl p-bromophenol, n-butyl p-bromophenol, n-amyl p-bromophenol, sec-amyl p-bromophenol, n-hexyl p-bromophenol, cyclohexyl p-bromophenol, o-bromophenol, tert-amyl o-bromophenol, n-hexyl o-bromophenol, n-propyl-m,m-dimethyl o-bromophenol, 2-phenyl phenol, 4-chloro-2-methyl phenol, 4-chloro-3-methyl phenol, 4-chloro-3,5-dimethyl phenol, 2,4-dichloro-3,5-dimethylphenol, 3,4,5,6-terabromo-2-methylphenol, 5-methyl-2-pentylphenol, 4-isopropyl-3-methylphenol, para-chloro-meta-xylenol, dichloro meta xylenol, chlorothymol, 5-chloro-2-hydroxydiphenylmethane, resorcinol and its derivatives including methyl resorcinol, ethyl resorcinol, n-propyl resorcinol, n-butyl resorcinol, n-amyl resorcinol, n-hexyl resorcinol, n-heptyl resorcinol, n-octyl resorcinol, n-nonyl resorcinol, phenyl resorcinol, benzyl resorcinol, phenylethyl resorcinol, phenylpropyl resorcinol, p-chlorobenzyl resorcinol, 5-chloro 2,4-dihydroxydiphenyl methane, 4-chloro 2,4-dihydroxydiphenyl methane, 5-bromo 2,4-dihydroxydiphenyl methane, and 4-bromo 2,4-dihydroxydiphenyl methane, bisphenolic compounds like 2,2-methylene bis (4-chlorophenol), 2,2-methylene bis(3,4,6-trichlorophenol), 2,2-methylene bis(4-chloro-6-bromophenol), bis(2-hydroxy-3,5-dichlorophenyl)sulphide, and bis(2-hydroxy-5-chlorobenzyl)sulphide, benzoic esters (parabens) like methylparaben, propylparaben, butylparaben, ethylparaben, isopropylparaben, isobutylparaben, benzylparaben, sodium methylparaben, and sodium propylparaben, halogenated carbanilides (e.g., 3,4,4-trichlorocarbanilides (Triclocarban or TCC), 3-trifluoromethyl-4,4-dichlorocarbanilide, 3,3,4-trichlorocarbanilide, etc.). The phenol based anti-microbials are advantageously used.

Preferred quaternary ammonium compounds which act as anti-microbial agents particularly those which have the structural formula:

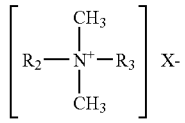

wherein $R_2$ and $R_3$ are the same or different $C_8$-$C_{12}$alkyl, or $R_2$ is $C_{12}$-$C_{16}$alkyl, $C_8$-$C_{18}$alkylethoxy, $C_8$-$C_{18}$alkyl-phenolethoxy and $R_2$ is benzyl, and X is a halide, for example chloride, bromide or iodide, or methosulphate. The alkyl groups $R_2$ and $R_3$ may be straight chain or branched, but are preferably substantially linear.

Fluorosurfactants may be included in the cleaning composition to improve the cleaning function, especially the surface wetting of surfaces treated by the article. Exemplary fluorocarbon surfactants include the anionic salts of perfluoroaliphaticoxybenzene sulphonic acids and the anionic salts of linear perfluoroalkyl-oxybenzoic acids. Examples of the former class of fluorocarbon surfactants can be represented by the following formula:

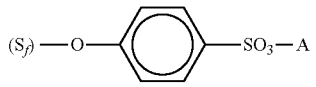

where $R_f$ is a perfluoroaliphatic group of from about 5 to about 15 carbon atoms, preferably from about 8 to 12 carbon atoms in the aliphatic group which may be an alkyl group or alkenyl group, and A is a cation such as an alkali metal, ammonium or amine.

Examples of the latter class of fluorocarbon surfactants can be represented by the formula:

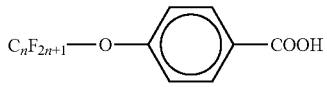

wherein n is a number of from about 2 to about 16 and m is a number from about 3 to about 34.

Other suitable fluorocarbon surfactants include:

(a) $R_fCH_2CH_2SCH_2CO_2M$ wherein $R_f$ is $F(CF_2CF_2)_n$ and n is from about 3 to about 8 and M is alkali metal (e.g., sodium or potassium) or ammonium;

(b) $C_nF_{2n+1}SO_3M$ wherein $C_nF_{2n+1}$ is a straight chain fluorocarbon radical, n is from about 8 to about 12 and M is alkali metal or ammonium;

(c) $C_nF_{2n+1}SO_3M$ wherein $C_nF_{2n+1}$ is a straight chain fluorocarbon radical, n is from about 8 to about 12 and M is an alkali metal cation;

(d) $R_fCH_2CH_2O(CH_2CH_2O)_nH$ wherein $R_f$ is a straight chain $F(CF_2CF_2)_n$ radical and n is from about 3 to about 8;

(e) $R_f(OCH_2CH_2)_nOR_f$ wherein $R_f$ is a branched chain radical of the formula $C_8F_{15+}C_{10}F_{19}$ or $C_{12}F_{23}$ and n is from about 10 to about 30; and (f) $R_f(OCH_2CH_2)_mOR$ wherein $R_f$ is a branched chain radical of the formula $C_8F_{15+}C_{10}F_{19}$ or $C_{12}F_{23}$, m is from about 2 to about 20 and R is $C_1$ to $C_3$ alkyl.

Fluorinated hydrocarbon surfactants are available from numerous commercial sources as trademarked products. Examples are ZONYL (trademark) fluorosurfactants, FLUORAD (trademark) fluorosurfactants, e.g., FLUORAD FC-129 ($R_fSO_2N(C_2H_5)CH_2CO_2^-K^+$, where $R_f$ is $C_nF_{2n+1}$ and n is about 8), and MONOFLOR (trademark) fluorocarbon.

The composition of the present invention may optionally comprise an acidizing agent, or other pH-adjusting agent.

Exemplary pH-adjusting agents include one or more organic or inorganic acids. Exemplary acids include one or more of sulphuric acid, hydrochloric acid, phosphoric acid, nitric acid, boric acid, formic acid, acetic acid, malic acid, maleic acid, succinic acid, tartaric acid, lactic acid, glutaric acid, glycolic acid, fumaric acid, benzoic acid, citric acid, sulphamic acid, oxalic acid, and mixtures thereof.

Further pH-adjusting agents include one or more agents selected from the group consisting of a hydroxide, a hydroxide generator, a buffer, and a mixture of same. Such pH-adjusting agents include alkali metal salts of various inorganic acids, such as alkali metal phosphates, polyphosphates, pyrophosphates, triphosphates, tetraphosphates, silicates, metasilicates, polysilicates, borates, carbonates, bicarbonates, hydroxides, and mixtures of same; preferred pH-adjusting agents are alkali metal hydroxides.

A cleaning composition may also include one or more alkanolamines which improve the cleaning of greasy soils, including one or more of: monoalkanolamines, dialkanolamines, trialkanolamines, and alkylalkanolamines such as alkyl-dialkanolamines, and dialkyl-monoalkanolamines. The alkanol and alkyl groups are generally short to medium chain length, that is, from 1 to 7 carbons in length. For di- and trialkanolamines and dialkyl-monoalkanolamines, these groups can be combined on the same amine to produce for example, methylethylhydroxypropylhydroxylamine. Such alkanolamines may also function as pH adjusting agents/pH buffers.

The cleaning composition may include a viscosity modifier, e.g., a thickener which increases the viscosity of the cleaning composition. Such may be desired if a more viscous cleaning composition is desired for use with the article of the invention. Exemplary useful viscosity modifiers include polysaccharide polymers e.g., cellulose, alkyl celluloses, alkoxy celluloses, hydroxy alkyl celluloses, alkyl hydroxy alkyl celluloses, carboxy alkyl celluloses, carboxy alkyl hydroxy alkyl celluloses as well as other modified celluloses, naturally occurring polysaccharide polymers such as xanthan gum, guar gum, locust bean gum, tragacanth gum, or derivatives thereof, polycarboxylate polymers, polyacrylamides, clays, and mixtures thereof.

The compositions may also be useful in depilatory methods. Removal of unwanted hair is regarded as a method of cleaning in this specification. The composition may contain an active depilatory compound, for example a sulphur-containing compound, most preferably sodium or potassium thioglycolate.

The composition of the present invention may comprise a multiple emulsion. This may be a water-in-oil-in-water (w/o/w) emulsion or an oil-in-water-in-oil (o/w/o) emulsion. The use of such emulsions in cleaning applications is described in GB application number 0308743. Such emulsions allow two water-soluble or two oleophilic cleaning agents or precursors thereto to be stored in separate phases and are only able to react when the multiple emulsion breaks down.

The preparation of the emulsions of the present invention may be carried out by standard techniques, which are well known to those skilled in the art.

The composition may further comprise (in one or more phases) optional ingredients such as fragrances and dyes.

The composition may contain components which are normally regarded as incompatible, held in respective phases of the emulsion. For example, in this way bleaching agents and enzymes could both be in the composition, but held apart in separate phases.

According to a second aspect of the present invention, there is provided a cleaning composition comprising a water-in-oil emulsion, of which the aqueous phase is at least 70% by weight; wherein the aqueous phase comprises a supersaturated solution of sodium acetate; and wherein the composition further comprises a surfactant which has an HLB value of ten or less.

In order to benefit from the composition of the present invention, it is believed that the emulsion must be broken down; i.e. that the phases which are held apart must be brought in contact.

According to a third aspect of the present invention there is provided a method of cleaning a surface, the method comprising the steps of:

a) applying to the surface a composition of the first or second aspect, and b) applying a force to the composition such that the emulsion breaks down and there is an increase in temperature of the composition.

The method preferably further comprises the step of:

c) removing the composition from the surface

Steps a) and b) need not be sequential. It may be that a force is applied during the process of delivering the composition to the surface, thus causing the emulsion to have broken down by the time it reaches the surface. For example, a composition may be delivered to a surface by a trigger spray. The action of pushing the composition through the nozzle may provide sufficient force to cause the emulsion to break down.

Alternatively, the composition may be applied to the surface and then a separate force may be applied. This may be in the form of a shear force produced for example by wiping with a cloth or applicator.

The surface cleaned in the method of the present invention may be a hard surface, for example a kitchen or bathroom surface, or the surface of a pipe, including a drain; or it may be a fabric surface, such as a carpet, soft furniture, curtains, or an item of clothing.

Due to the large exotherm produced during the crystallization of sodium acetate, the present invention may be particularly useful to assist the removal of difficult stains or soils.

In one embodiment, the composition comprises degreasers and is used as an oven cleaner to remove deposits of fat and burnt food.

In another embodiment, the composition comprises an acidic species and is used to remove limescale deposits in the bathroom.

Alternatively or additionally the composition may comprise an acidizing fluid, rendering it an acidic liquid. Acidizing fluids are described inter alia in WO 01/52976, U.S. Pat. No. 4,140,640 and U.S. Pat. No. 4,233,165, the contents of which are incorporated herein by reference.

In a further embodiment, the composition may comprise a bleach or an enzyme, and is applied as a laundry pre-treatment agent to assist removal of stubborn stains. In such embodiments, the enzyme is selected so that it has optimal performance at the temperature provided by applying a force to the emulsion of the present invention.

In the method of the present invention, the composition is preferably left on the surface for a period of time sufficient for maximum cleaning to be achieved. Suitably this period is at least 10 seconds, more preferably at least 30 seconds and most preferably at least 60 seconds.

Preferably this period is less than 2 hours, more preferably less than 1 hour, most preferably less than 30 minutes.

Following such a period, the composition is removed. This is by wiping or washing away the composition. In the case of an oven-cleaning composition, this can be removed by using a cloth. The composition and dislodged grease can be wiped away and then further wiping with a wet cloth can remove any remaining traces of the composition.

A bathroom-cleaning composition may be wiped away or may be simply rinsed away if appropriate, using the shower, for example.

In the case of a laundry pre-treatment composition, this is applied to a localised area which is stained and left for a period sufficient to allow effective cleaning (typically 5 to 15 minutes). The item of laundry may then be placed directly in a clothes washing machine and the composition will be rinsed away naturally during the wash.

In a further embodiment, a composition could be applied to, for example, a particularly dirty pan or plate prior to washing in a dish-washing machine.

The composition of the present invention may easily be removed during an aqueous wash as the emulsion preferably comprises 80-90% by weight of the aqueous phase.

In another embodiment the composition is a personal cleaning composition, for use on the skin or the hair of a person. For example it may be a hand wash, body wash, shampoo or hair conditioner. It may be especially useful as a handwash when only cold water is available.

The invention will now be further described by way of example.

EXAMPLE

An oil-in-water emulsion was prepared containing the following components:

| | Mass |
|---|---|
| Aqueous phase | |
| sodium acetate | 46.75 g |
| water | 37.85 g |
| sodium hydroxide | 0.4 g |
| Oil phase | |
| stearic acid | 2.84 g |
| paraffin oil | 11.11 g |
| fragrance | 0.05 g |
| Surfactant/emulsifier | |
| $C_{28}$-polyisobutene succinamide | 1 g |
| Total | 100 g |

The composition was applied to a grease stain on a cotton T-shirt using a roller ball device and the area was rubbed with a cloth. This generated soap in situ and the sodium acetate crystallised. This crystallisation causes the temperature of the treated region to rise to 45° C. After 10 minutes, the T-shirt was added to a 5 kg load in a standard clothes washing machine and a standard 40° C. wash was carried out using a standard commercial non-biological washing liquid in a standard manner. Also included in the wash was an identical T-shirt also having the same grease stain.

At the end of the wash, the T-shirt which had been pretreated had no visible mark but the other T-shirt showed a stain to still be present.

The invention claimed is:

1. A cleaning composition comprising a water-in-oil emulsion which comprises an aqueous phase in the form of droplets surrounded by a continuous non-aqueous oily phase, which upon breakdown of the emulsion undergoes a crystallization which is accompanied by an increase in temperature of the composition.

2. A cleaning composition according to claim 1 wherein the aqueous phase comprises at least 60% by weight of the composition.

3. A cleaning composition according to claim 1 wherein the aqueous phase comprises a supersaturated solution of sodium acetate.

4. A cleaning composition according to claim 1 wherein the composition comprises up to 10% by weight of a surfactant having an HLB value of 10 or less.

5. A cleaning composition according to claim 4 wherein the surfactant is formed by reaction of a substituted succinic acid or succinic anhydride with a polyol, polyamine or hydroxyamine, or mixtures thereof.

6. A cleaning composition according to claim 1 which comprises one or more active cleaning agents selected from: oxygen-supplying compounds, bleaches, enzymes, grease cutting agents, glossing agents, builders, soil suspension agents, polishes, dye capture agents and anti-dye deposition agents.

7. A cleaning composition according to claim 1 which comprises one or more active cleaning agents which are generated in situ when the water-in-oil emulsion breaks down.

8. A cleaning composition according to claim 7 wherein a cleaning agent precursor is present in the oil phase, and another cleaning agent precursor is present in the water phase.

9. A cleaning composition comprising an oil-in-water emulsion wherein the water phase comprises a supersaturated solution of sodium acetate, which upon breakdown of the emulsion undergoes a crystallization which is accompanied by an increase in the temperature of the composition.

10. A cleaning composition according to claim 9 wherein the aqueous phase comprises at least 60% by weight of the composition.

11. A cleaning composition according to claim 9 which comprises up to 10% by weight of a surfactant having an HLB value of 10 or less.

12. A cleaning composition according to claim 9 wherein the surfactant is formed by reaction of a substituted succinic acid or succinic anhydride with a polyol, polyamine or hydroxyamine, or mixtures thereof.

13. A cleaning composition according to claim 9 which comprises one or more active cleaning agents selected from: oxygen-supplying compounds, bleaches, enzymes, grease cutting agents, glossing agents, builders, soil suspension agents, polishes, dye capture agents and anti-dye deposition agents.

14. A cleaning composition according to claim 9 which comprises one or more active cleaning agents which are generated in situ when the oil-in-water emulsion breaks down.

15. A cleaning composition according to claim 9 wherein the one cleaning agent precursor is present in the oil phase, and another cleaning agent precursor is present in the water phase.

* * * * *